US007269958B2

(12) United States Patent
Stastny et al.

(10) Patent No.: US 7,269,958 B2
(45) Date of Patent: Sep. 18, 2007

(54) COMBUSTOR EXIT DUCT

(75) Inventors: Honza Stastny, Georgetown (CA); Robert Sze, Mississauga (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 269 days.

(21) Appl. No.: 10/937,340

(22) Filed: Sep. 10, 2004

(65) Prior Publication Data

US 2006/0053797 A1 Mar. 16, 2006

(51) Int. Cl.
*F02C 7/20* (2006.01)
*F23R 3/06* (2006.01)
*F23R 3/54* (2006.01)

(52) U.S. Cl. ..... 60/804; 60/752; 60/754; 60/760

(58) Field of Classification Search ..... 60/752, 60/754, 760, 804
See application file for complete search history.

(56) References Cited

U.S. PATENT DOCUMENTS 3,995,422 A 12/1976 Stamm
4,329,848 A 5/1982 Caruel et al.
4,549,402 A 10/1985 Saintsbury et al.
4,773,593 A 9/1988 Auxier et al.
4,878,283 A 11/1989 McLean
4,996,838 A 3/1991 Melconian
5,142,871 A 9/1992 Lampes et al.
5,241,827 A 9/1993 Lampes
5,265,425 A 11/1993 Howell
5,279,127 A 1/1994 Napoli
5,335,502 A 8/1994 Roberts, Jr. et al.
5,407,133 A 4/1995 Liang
6,079,199 A * 6/2000 McCaldon et al. ..... 60/800
6,253,538 B1 7/2001 Sampath et al.
6,408,629 B1 6/2002 Harris et al.
6,427,446 B1 8/2002 Kraft et al.
6,553,767 B2 4/2003 Farmer et al.
6,651,437 B2 11/2003 Farmer et al.
6,675,582 B2 1/2004 Monty et al.
6,735,949 B1 * 5/2004 Haynes et al. ..... 60/746
6,955,053 B1 * 10/2005 Chen et al. ..... 60/804
2002/0162331 A1 11/2002 Coutandin

FOREIGN PATENT DOCUMENTS

CA 2333936 12/1999

* cited by examiner

*Primary Examiner*—Ted Kim
(74) *Attorney, Agent, or Firm*—Ogilvy Renault LLP

(57) ABSTRACT

A combustor for a gas turbine engine includes a sheet metal combustor wall having a plurality of cooling apertures therein immediately upstream of a corner between two intersecting combustor wall portions.

15 Claims, 3 Drawing Sheets

COMBUSTOR EXIT DUCT

TECHNICAL FIELD

The present invention relates generally to gas turbine engine combustors and, more particularly, to a low cost combustor construction.

BACKGROUND OF THE ART

Cooling of gas turbine sheet metal combustor walls is typically achieved by directing cooling air through holes in the combustor wall to provide effusion and/or film cooling. These holes may be provided as machined cooling rings positioned around the combustor or effusion cooling holes in a sheet metal liner. Opportunities for improvement are continuously sought, however, to improve both cost and cost effectiveness.

SUMMARY OF THE INVENTION

One aspect of the present invention provides an improved gas turbine combustor wall.

In accordance with the present invention there is provided a combustor for a gas turbine engine comprising: an inner reverse-flow annular combustor liner; and an outer reverse-flow annular sheet metal combustor liner, the outer liner including a long exit duct portion adapted to redirect combustion gases in the combustor towards a combustor exit, the outer liner including at least two smooth continuous wall portions intersecting each other at a discontinuity, the two smooth continuous wall portions providing an upstream wall and a downstream wall relative to the discontinuity, the two smooth continuous wall portions defining an obtuse inner angle therebetween at the discontinuity, the upstream wall having a plurality of apertures defined therein immediately adjacent the discontinuity, the apertures adapted to deliver pressurized air surrounding the outer liner through the outer liner and along the downstream wall.

In accordance with the present invention, there is also provided a gas turbine combustor comprising a sheet metal reverse flow annular combustor wall having at least one corner in an outer wall of a long exit duct portion of the combustor, the long exit duct portion being adapted to substantially reverse the general direction of a flow of combustion gases therethrough, the corner defining an angle between intersecting wall portions of the long exit duct, the wall portion upstream of the corner having a plurality of cooling apertures defined therein immediately upstream of the corner, the cooling apertures adapted to direct a cooling air flow form outside the combustor therethrough and adjacent an inner surface of the wall portion downstream of the corner.

In accordance with the present invention, there is also provided a method of cooling a long exit duct of a gas turbine engine reverse flow annular combustor, the method comprising the steps of: determining at least one expected region of local high temperature adjacent an inner surface of the long exit duct sheet metal wall; providing a long exit duct comprising a sheet metal wall; forming an apex in the sheet metal wall immediately upstream of the local high temperature region, the apex being defined between integrally formed planar wall portions comprising a substantial portion of the sheet metal wall which abut one another along the apex and define an inner angle therebetween; and directing cooling air through apertures defined in the long exit duct wall immediately upstream of the apex, such that the cooling air cools an inner surface of the combustor wall downstream of the corner within the local high temperature region.

There is also provided, in accordance with the present invention, a method of forming a gas turbine engine annular reverse flow combustor comprising: determining a preliminary design of the annular reverse flow combustor, the annular reverse flow combustor having a long exit duct wall; determining at least one expected region of local high temperature adjacent an inner surface of the long exit duct wall; and forming at least the long exit duct wall of the annular reverse flow combustor out of sheet metal, including the steps of: forming at least one apex in the long exit duct wall immediately upstream of the local high temperature region, the apex defining an inner angle between upstream and downstream portions the long exit duct wall; and creating cooling air apertures through the long exit duct wall immediately upstream of the apex, the cooling apertures being adapted to direct a cooling air flow from outside the combustor therethrough and adjacent the downstream portion of the long exit duct wall within the local high temperature region.

Further details of these and other aspects of the present invention will be apparent from the detailed description and Figures included below.

DESCRIPTION OF THE DRAWINGS

Reference is now made to the accompanying Figures depicting aspects of the present invention, in which.

DETAILED DESCRIPTION OF PREFERRED EMBODIMENTS

Figure 1:
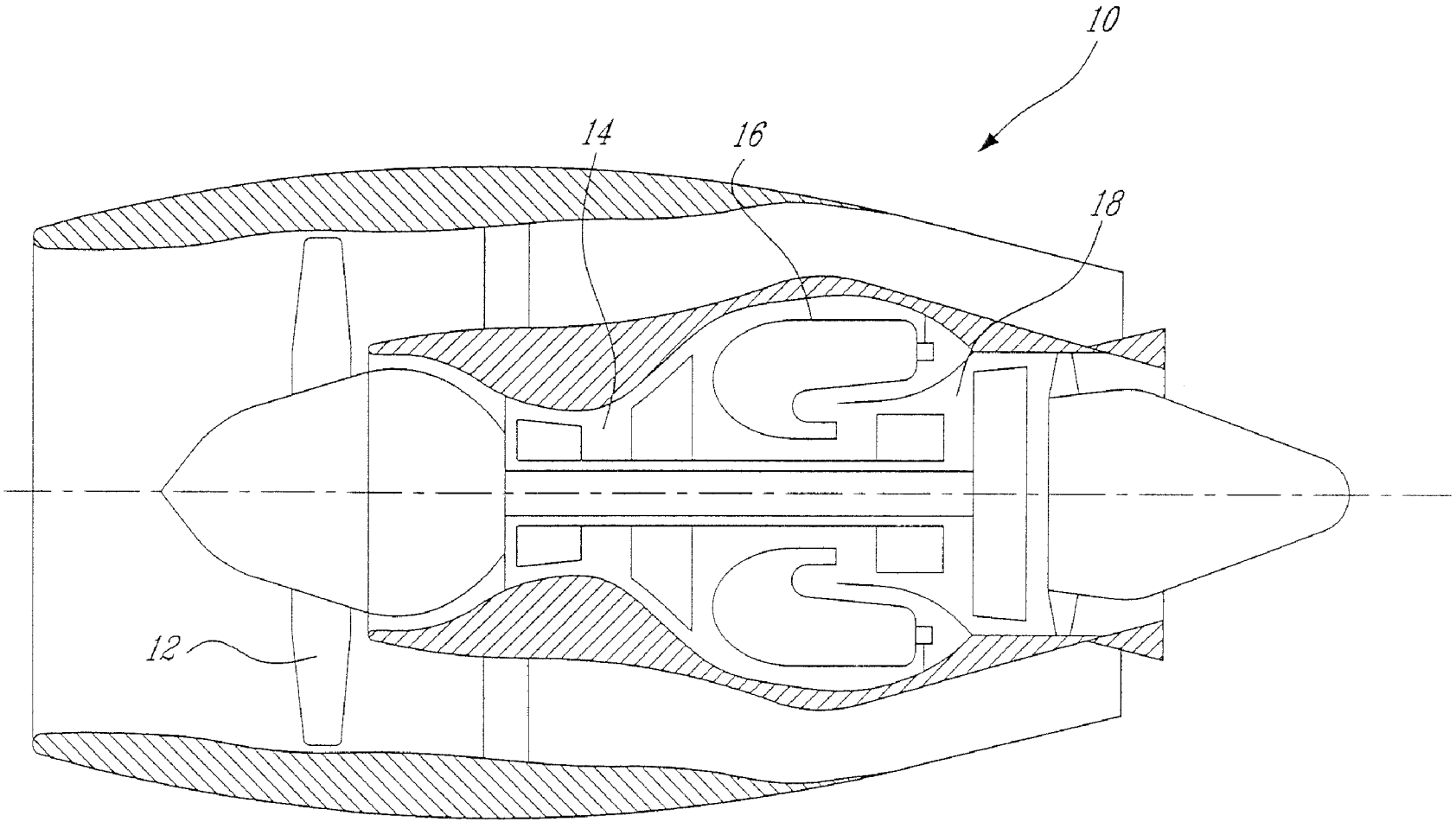
FIG. 1 shows a schematic partial cross-section of a gas turbine engine.

FIG. 1 illustrates a gas turbine engine 10 preferably of a type provided for use in subsonic flight, generally comprising in serial flow communication a fan 12 through which ambient air is propelled, a multistage compressor 14 for pressurizing the air, a reverse flow annular combustor 16 in which compressed air is mixed with fuel and ignited for generating an annular stream of hot combustion gases which is then redirected by combustor 16 to a turbine section 18 for extracting energy from the combustion gases.

Figure 2:
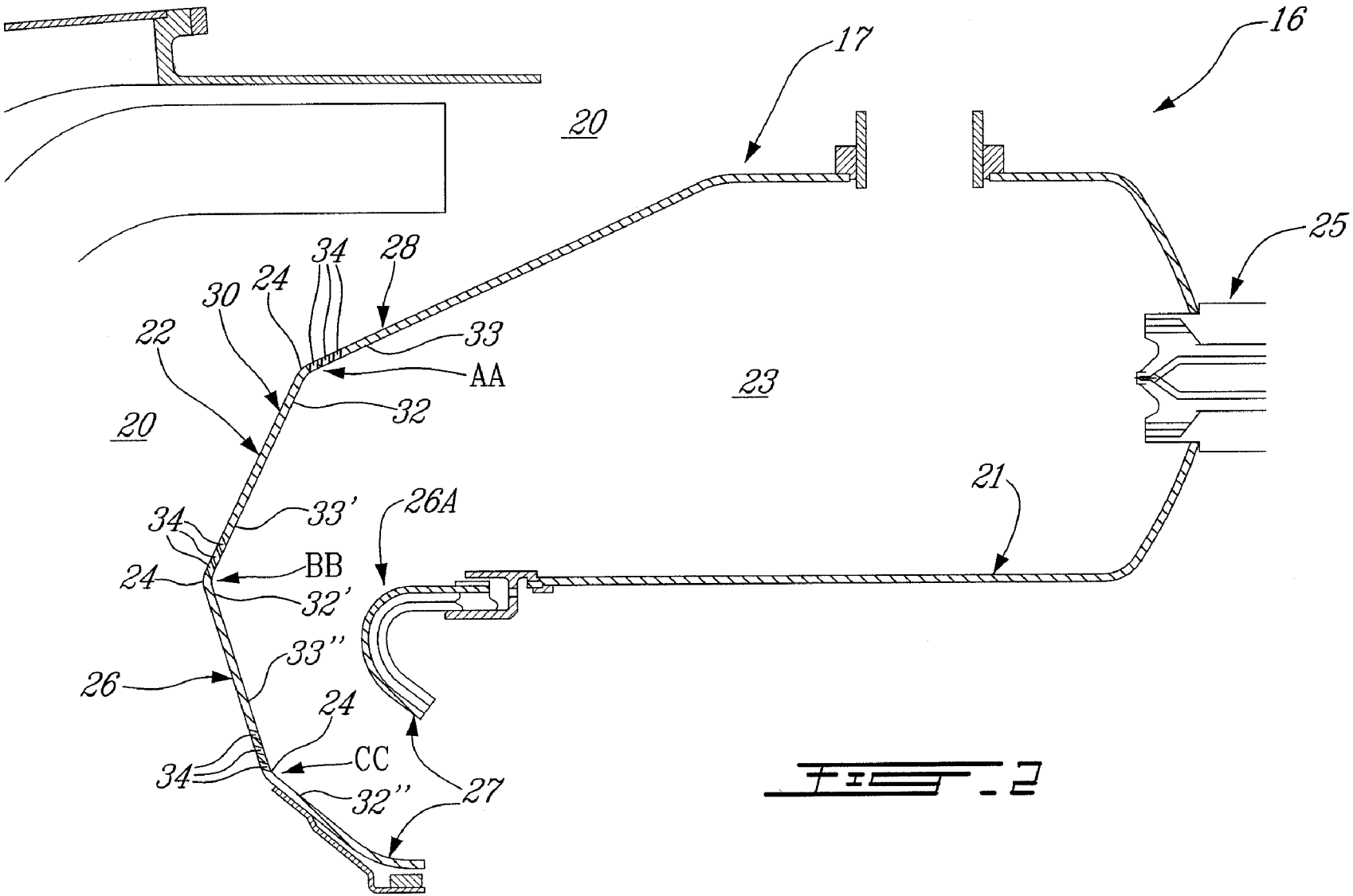
FIG. 2 shows a partial cross-section of a reverse flow annular combustor having a long exit duct in accordance with one aspect of the present invention.

Referring to FIG. 2, in one embodiment, the combustor 16 comprises generally a combustor liner 17, having an inner liner portion 21 and an outer liner portion 22 defining a combustion chamber 23 therebetween. Outer liner 22 includes a long exit duct portion 26, while inner liner 21 includes a small exit duct portion 26A, both leading to a combustor exit 27 adapted to communicate with a downstream turbine stage. An air plenum 20, which surrounds the combustor liner 17, receives compressed air from the compressor section 14 of the gas turbine engine 10. The combustor liner 17 is provided in a single ply of sheet metal. At least one fuel nozzle 25 communicates with the combustion chamber 23. In use, compressed air from plenum 20 enters combustion chamber through a plurality of holes (discussed further below) and is ignited and fueled by fuel injected though nozzles 25. Hot combusted gases within the combustion chamber 23 are then directed forward through the long exit duct portion 26 of the combustor, which redirects the flow aft towards a high pressure turbine (not shown).

Cooling of the outer liner 22 is non-exclusively provided by a plurality of cooling apertures 34, which permit fluid flow communication between the outer surrounding air plenum 20 and the combustion chamber 23 defined within the combustor liner 17.

The combustor wall 22 has a plurality of "corners" or apexes 24 therein, defined by the discontinuous or relatively "sharp" intersection of angled portions, for example the portions indicated 28 and 30 in FIG. 2. The corners 24 define obtuse inner angles AA, BB and CC, respectively, between frustoconical surfaces, for example the inner wall surfaces indicated 32 and 33 in FIG. 2. The obtuse inner angles AA, BB and CC preferably have an angle between about 100° and about 170°, but more preferably an angle between about 130° and about 150°. The particular locations of the corners 24 are selected to correspond to predetermined "hotspots" in the combustor, i.e. local regions of undesirably high temperature. Particularly, the corner 24 are preferably positioned immediately upstream of such local regions of high temperature. The relatively sharp bends created by the corner or apexes 24 defined in the combustor wall 22 act to help maximize cooling within the combustion chamber 23. The flow of hot combustion gases within the combustion chamber 23 is forced to reverse its direction as is flows through the exit duct portion of the reverse flow combustion chamber. The corners 24 tend to force the gas flow to turn relatively sharply. Thus, the hot gas flow tends to impact on the inner surface of the combustor wall just downstream of the corner, and as a result this region experiences increased "pounding" of the hot gas flow which is forced to substantially change direction at that point. Thus, by cooling this same region using the cooling apertures 34, described in greater detail below, to inject lower temperature cooling air jets, overall cooling of the combustion gas flow is maximized. By locating corners 24 and their associated cooling apertures 34 at several points in the long exit duct portion of the combustor wall, a cooling film is provided and stabilized on the inner surfaces of the wall.

A plurality of cooling apertures 34 are defined in the combustor wall immediately upstream of, and locally adjacent, each corner 24. The cooling apertures 34 are adapted to direct cooling air from plenum 20 through the liner and thereafter adjacent and generally parallel the flat or frustoconcial (as the case may be) surface downstream of the corner 24 (e.g. surface 32), to cool the liner and thereby alleviate the above-mentioned hotspots. The cooling apertures 34 may be provided by any suitable means, however laser drilling is preferred. The cooling apertures 34 are preferably formed such that they extend parallel to the wall portion downstream of the corner 24. However, it is to be understood that a small angular deviation from this parallel configuration of the apertures may be necessary for manufacturing reasons. However, an angular deviation away from parallel preferably should not exceed 6 degrees. If laser drilling is employed, the laser beam used to cut the cooling aperture through the sheet metal wall could potentially scratch or scar the downstream wall surface. Therefore, such a small angular deviation away from parallel may be desirable to avoid damage to the wall of the long exit duct.

The combustor wall 22 may include additional cooling means, such as a plurality of small effusion cooling holes throughout the liner surface area. Where effusion cooling holes are provided, the location of the corners 24 may also be selected such that they are located to additionally stabilize the cooling film provided by effusion cooling along the inner side of the wall, and thereby holes 34 of the present invention revive or refresh this film cooling flow to thereby effect increased liner cooling.

Figure 3:
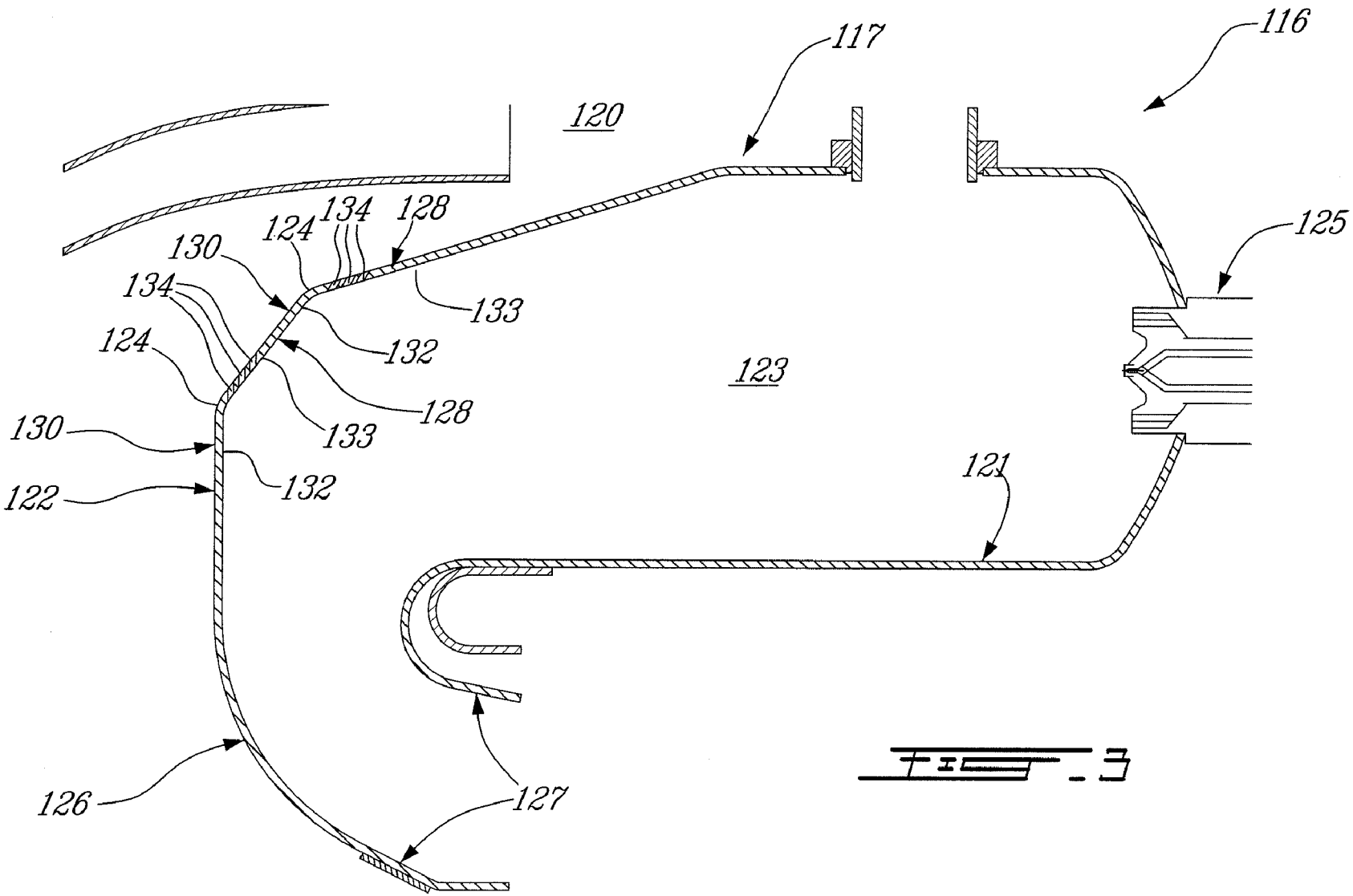
FIG. 3 shows a partial cross-section of a reverse flow annular combustor in accordance with another embodiment of the present invention.

Referring now to FIG. 3, an another embodiment is shown in which elements having similar function to the embodiment of FIG. 2 are provided similar reference numerals incremented by one hundred. In this embodiment, the long exit duct portion 126 includes two corners 124 defined therein, each of which has a plurality of cooling apertures 134 defined immediately upstream of the corners 124. The wall portions 128 and 130 are angled with respect to each other to define an obtuse angle between surfaces 132 and 133.

The cooling apertures 34, 134 are preferably aligned generally parallel to the wall portion downstream of the corners 24, 124, such that cooling air passing therethrough is directed in a film substantially along the inner surface of said wall parallel thereto. The surfaces on either side of the corners corner 24, 124 (e.g. surfaces 32 and 33, and 132 and 133) are preferably "flat" or "smooth" in the sense that they are a simple and single (i.e. linear) surface of revolution about the combustor axis (not shown, but which is typically an axis coincident with the engine axis denoted by the stippled line in FIG. 1.) However, it remains also possible that the wall surfaces on either side of the corners comprise curved surfaces. However, it is generally more cost and time efficient, and therefore preferable, to manufacture flat walls when possible. The surfaces on either side of the corners corner 24 in FIG. 2 are all frustoconical. The surfaces on either side of the corners 124 in FIG. 3 are either frustoconical or fully planar. In either case, these surfaces on either side of the corners 24, 124 preferably comprise the substantial majority of, if not all of, the long exit duct portion 26 of outer liner 22. These surfaces on either side of the corners 24, 124 are preferably "continuous" in the sense that they are free from surface discontinuities such as bends, steps, kinks, etc. Any number of corners (i.e. one or more) may be provided, as desired. It is to be understood that the term "sharp" is used loosely herein to refer generally to a non-continuous (or discontinuous) transition from one defined surface area to another. Such "sharp" corners will of course be understood by the skilled reader to have a such a radius of curvature as is necessary or prudent in manufacturing same. However, this radius of curvature is preferably relatively small, as a larger radius will increase the length of the corner portion between the upstream and downstream surface areas, which tends to place most of the bend into a region which receives less cooling effect from the cooling air apertures defined upstream thereof. This can further add to hot spot formation within the combustion chamber, rather than reducing them.

Although the plurality of cooling apertures 34 are depicted in sets of three substantially parallel apertures, it is to be understood that any particular configuration, number, relative angle and size of apertures may be employed. Preferably, however, the apertures are grouped in sets immediately upstream of each corner defined in the combustor wall.

The above description is therefore meant to be exemplary only, and one skilled in the art will recognize that further changes may be made to the embodiments described without departing from the scope of the invention disclosed. Still other modifications will be apparent to those skilled in the art, in light of a review of this disclosure, and such modifications are intended to fall within the appended claims.

We claim:

1. A combustor for a gas turbine engine comprising:

an inner reverse-flow annular combustor liner; and an outer reverse-flow annular sheet metal combustor liner, the outer liner including a long exit duct portion adapted to redirect combustion gases in the combustor towards a combustor exit, the long exit duct portion of the outer liner including at least two discontinuities between smooth continuous wall portions on either side of the discontinuities, the wall portions intersecting each other at the discontinuities to define an obtuse inner angle therebetween, the smooth continuous wall portions including an upstream wall and a downstream wall relative to each of the discontinuities, the downstream wall of a first one of the discontinuities being coplanar with the upstream wall of a second one of the discontinuities upstream from the first one, the coplanar downstream and upstream walls extending rectilinearly and uninterrupted between the first and second discontinuities, the upstream wall having a plurality of apertures defined therein immediately upstream of each of the discontinuities, the apertures each extending through the upstream wall at an angle such that the apertures are substantially parallel to the downstream wall, the apertures thereby delivering pressurized air surrounding the outer liner through the outer liner and along the downstream wall in a direction substantially parallel to the downstream wall.

2. The combustor as defined in claim 1, wherein the discontinuity provides a sharp corner.

3. The combustor as defined in claim 1, wherein the combustor includes three of said smooth continuous wall portions respectively separated by two of said discontinuities.

4. The combustor as defined in claim 1, wherein the combustor includes four of said smooth continuous wall portions respectively separated by three of said discontinuities.

5. The combustor as defined in claim 1, wherein the at least two smooth continuous wall portions comprise a substantial portion of the long exit duct portion.

6. The combustor as defined in claim 1, wherein the corner is positioned in the combustor wall at a predetermined position corresponding to an expected local region of high temperature within the combustion chamber and thereby adapted to cool said region.

7. The combustor as defined in claim 1, wherein the at least two smooth continuous wall portions comprise surfaces of revolution relative to a combustor axis.

8. The combustor as defined in claim 7, wherein at least one of the at least two smooth continuous wall portions is frustoconical.

9. The combustor as defined in claim 8, wherein all of the at least two smooth continuous wall portions are frustoconical.

10. The combustor as defined in claim 8, wherein at least one of the at least two smooth continuous wall portions is planar and substantially perpendicular to the combustor axis.

11. A gas turbine combustor comprising a sheet metal reverse flow annular combustor wall having at least one corner in an outer wall of a long exit duct portion of the combustor, the long exit duct portion being adapted to substantially reverse the general direction of a flow of combustion gases therethrough, the corner defining an angle between intersecting stream and downstream wall portions of the long exit duct, the upstream wall portion being frustoconical and sloping radially inwards to the corner in a direction towards a central axis of the combustor, the upstream wall portion having a plurality of cooling apertures defined therein immediately upstream of the corner, the apertures each defining a central axis therethrough which is substantially parallel to the downstream wall portion, the cooling apertures adapted to direct a cooling air flow from outside the combustor therethrough and adjacent an inner surface of the downstream wall portion in a direction substantially parallel to the downstream wall portion.

12. The gas turbine combustor as defined in claim 11, wherein the angle is obtuse.

13. The gas turbine combustor as defined in claim 11, wherein the combustor includes three of said wall portions respectively separated by two of said corners.

14. The gas turbine combustor as defined in claim 11, wherein the combustor includes four of said wall portions respectively separated by three of said corners.

15. The gas turbine combustor as defined in claim 11, wherein the portions comprise a substantial portion of the long exit duct portion.

* * * * *